US009739160B2

(12) United States Patent
Kain et al.

(10) Patent No.: US 9,739,160 B2
(45) Date of Patent: Aug. 22, 2017

(54) ADJUSTABLE BLADE ROOT SPRING FOR TURBINE BLADE FIXATION IN TURBOMACHINERY

(71) Applicant: Siemens Aktiengesellschaft, München (DE)

(72) Inventors: Jeffrey A. Kain, Oviedo, FL (US); Mohit Gupta, Kissimmee, FL (US); Leonard J. Meyer, Mesa, AZ (US); Ryan S. Yamane, Phoenix, AZ (US); James A. Chonody, Orlando, FL (US); Charalambos Polyzopoulos, Orlando, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 545 days.

(21) Appl. No.: 14/457,504

(22) Filed: Aug. 12, 2014

(65) Prior Publication Data

US 2015/0110635 A1 Apr. 23, 2015

Related U.S. Application Data

(60) Provisional application No. 61/892,824, filed on Oct. 18, 2013.

(51) Int. Cl.
*F01D 5/32* (2006.01)
*F01D 5/30* (2006.01)
(Continued)

(52) U.S. Cl.
CPC ..... *F01D 5/323* (2013.01); *F01D 5/16* (2013.01); *F01D 5/26* (2013.01); *F01D 5/30* (2013.01);
(Continued)

(58) Field of Classification Search
CPC .. F01D 5/323; F01D 5/326; F01D 5/30–5/34; F01D 5/10; F01D 5/16;
(Continued)

(56) References Cited

U.S. PATENT DOCUMENTS 4,820,127 A 4/1989 Cohen et al.
5,123,813 A 6/1992 Przytulski et al.
(Continued)

FOREIGN PATENT DOCUMENTS

DE 102012213227 B3 9/2013
EP 1643082 A1 4/2006
(Continued)

*Primary Examiner* — Gregory Anderson
*Assistant Examiner* — Julian Getachew

(57) ABSTRACT

An adjustable blade root spring device for turbine blade fixation in turbomachinery. The device is designed to be placed in a space in a rotor disk cavity adjacent to a tip of a blade root fir tree, where the device applies a radial outward force on the turbine blade to fix the blade position in the rotor disk. The device includes an accordion-shaped spring which is compressed by a bolt and a coil spring. When the accordion spring is compressed in length, it increases in height and makes contact with the rotor disk and the turbine blade. The force of the accordion spring on the turbine blade can be adjusted via the bolt, and the coil spring provides an increased compliance range. The device can be inserted into the space without scraping against the blade root or the rotor disk, and expanded once it is in position.

17 Claims, 8 Drawing Sheets

(51) Int. Cl.
*F01D 5/16* (2006.01)
*F01D 5/26* (2006.01)

(52) U.S. Cl.
CPC ..... *F01D 5/3007* (2013.01); *F05D 2220/32* (2013.01)

(58) Field of Classification Search
CPC ..... F01D 5/26; F01D 5/3007; F01D 5/3015; F01D 25/04; F01D 25/06
USPC ..... 416/220 R, 221
See application file for complete search history.

(56) References Cited

U.S. PATENT DOCUMENTS

| | | | |
|---|---|---|---|
| 5,236,309 | A | 8/1993 | Van Heusden et al. |
| 5,431,543 | A | 7/1995 | Brown et al. |
| 6,447,253 | B2 | 9/2002 | Tempere |
| 6,905,311 | B2 | 6/2005 | Leathart |
| 7,047,843 | B1 | 5/2006 | Huang |
| 7,198,463 | B2 | 4/2007 | Kanebako et al. |
| 7,806,662 | B2 | 10/2010 | Gekht et al. |
| 8,192,167 | B2 | 6/2012 | Helmis et al. |
| 8,485,785 | B2 | 7/2013 | Garner et al. |
| 2004/0062653 | A1 | 4/2004 | Di Paola et al. |
| 2010/0284805 | A1 | 11/2010 | Uskert et al. |

FOREIGN PATENT DOCUMENTS

| | | | |
|---|---|---|---|
| EP | 2149677 | A1 | 2/2010 |
| JP | 2012202391 | A1 | 10/2012 |

ADJUSTABLE BLADE ROOT SPRING FOR TURBINE BLADE FIXATION IN TURBOMACHINERY

CROSS-REFERENCE TO RELATED APPLICATIONS

This application claims the benefit of the priority date of U.S. Provisional Patent Application Ser. No. 61/892,824, titled ADJUSTABLE BLADE ROOT SPRING FOR TURBINE BLADE FIXATION IN TURBOMACHINERY, filed Oct. 18, 2013.

BACKGROUND OF THE INVENTION

Field of the Invention

This invention relates generally to a device for fixing a turbine blade's position relative to a rotor disk in a combustion gas turbine and, more particularly, to an adjustable blade root spring device which can be freely inserted in a space beneath the blade root, then compressed via an axial bolt so that an accordion-shaped spring increases in height and presses the blade radially outward relative to the rotor disk, thus positively engaging the blade root with its mating surfaces in the disk even when no centrifugal load is present.

Description of the Related Art

Combustion gas turbines are clean-burning, efficient devices for generating power for a variety of applications. One common application of combustion gas turbines is in power plants, where the turbine drives a generator which produces electricity. Such stationary gas turbines have been developed over the years to improve reliability and efficiency, but the continuous improvement quest never ends.

Turbine blades are airfoils which are arranged circumferentially around a rotor disk inside the turbine, where rows of rotating blades are alternately positioned between rows of stationary turbine vanes. Because turbine blades are directly exposed to combustion gases, they get extremely hot. Blades are also subject to combustion gas pressure, centrifugal force and vibration. Thus, turbine blades may become damaged or worn over time, and they therefore need to be easily replaceable.

A common and reliable design for the attachment of turbine blades to the rotor disk is where the blade root has an inverted "fir tree" shape, and the disk has a complementary fir tree shaped cavity. With this design, a blade can be installed in a disk by simply sliding the blade in a longitudinal direction (parallel to the rotational axis of the turbine) so that the blade root fir tree engages with the mating cavity in the rotor disk. In this design, there is necessarily some looseness between the blade root and the disk cavity, both to allow for easy installation and removal, and to allow for differing radial growths due to thermal expansion and/or centrifugal forces. When the turbine is running at operational speed, centrifugal force pulls the blades radially outward so that the looseness is all taken up, and contact points on the branches of the fir tree are pressed tightly against each other. However, turbines are sometimes operated in a low-speed "stand by" mode, where the centrifugal force of rotation is not enough to overcome the force of gravity, and as a result, each blade experiences radial inward/outward and rocking movements on each rotation of the turbine. Over long durations, these repeated movements of the blade relative to the disk cause excessive wear on contact points of the blade fir trees and disk cavities, as well as on blade tip shrouds.

SUMMARY OF THE INVENTION

In accordance with the teachings of the present invention, an adjustable blade root spring device for turbine blade fixation in turbomachinery is disclosed. The blade root spring device is designed to be placed in a space in a rotor disk cavity adjacent to a tip of a blade root fir tree, where the device applies a radial outward force on the turbine blade to fix the blade position in the rotor disk. The device includes an accordion-shaped spring which is compressed by a bolt and a coil spring. When the accordion spring is compressed in length, it increases in height and makes contact with the rotor disk and the turbine blade. The force of the accordion spring on the turbine blade can be adjusted via the bolt, and the coil spring provides an increased compliance range. The device can be inserted into the space without scraping against the blade root or the rotor disk, and expanded once it is in position.

Additional features of the present invention will become apparent from the following description and appended claims, taken in conjunction with the accompanying drawings.

DETAILED DESCRIPTION OF THE EMBODIMENTS

The following discussion of the embodiments of the invention directed to an adjustable blade root spring device for turbine blade fixation in turbomachinery is merely exemplary in nature, and is in no way intended to limit the invention or its applications or uses. For example, the blade root spring device is discussed below in the context of a combustion gas turbine, but the device may also be applicable in fixing blades of a steam turbine, or blades in other rotating machinery.

Figure 1:
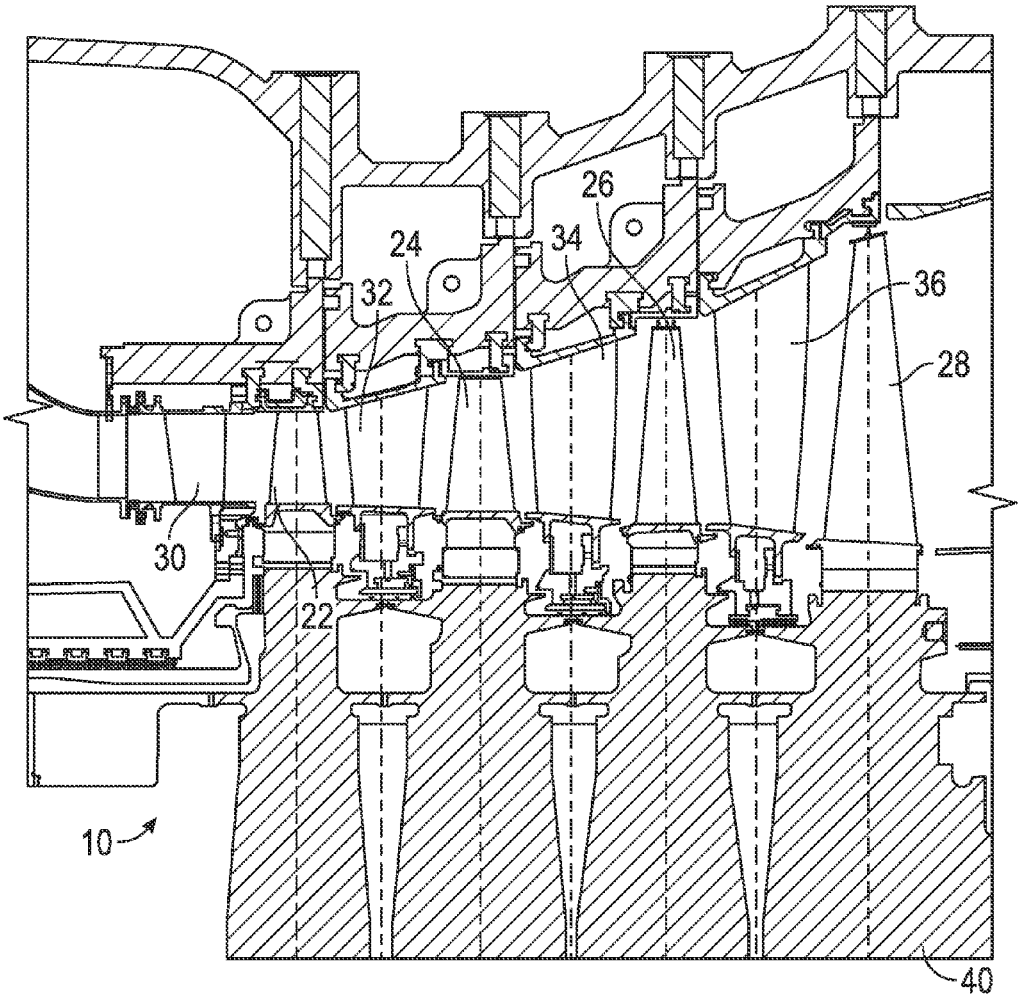
FIG. 1 (Prior Art)
FIG. 1 is a cross-sectional diagram of a combustion gas turbine, showing an arrangement of blades and vanes.

FIG. 1 is a cross-sectional diagram of a combustion gas turbine 10, such as the type which is used to drive an electrical generator in a power plant. As is understood by anyone familiar with turbomachinery, the turbine 10 includes a series of blades (22, 24, 26, 28) and vanes (30, 32, 34, 36). As can be seen in FIG. 1, the blades 22-28 and the vanes 30-36 are arranged in alternating rows along the length of the turbine 10. Each row of blades is attached to a rotor disk which rotates with a power shaft, where the power shaft drives downstream machinery such as a generator. For example, the fourth row blades 28 are attached to a rotor disk 40. The vanes 30-36 are fixed in place, being attached to inner and outer casings. The vanes 30-36 are airfoils which serve to direct and accelerate the flow of combustion gas as it expands, turns the blades 22-28 and passes through the turbine 10.

Modern combustion gas turbines such as the turbine 10 operate at very high temperatures and pressures for both efficiency and power density reasons. Even with advances in material technology, the turbine blades 22-28 can eventually become worn or damaged due to the temperatures, pressures and forces they experience. Therefore, it is necessary to be able to replace individual turbine blades in a straightforward manner, while ensuring that the blade-to-disk attachment mechanism is strong enough to withstand the applied loads and vibration.

Figure 2:
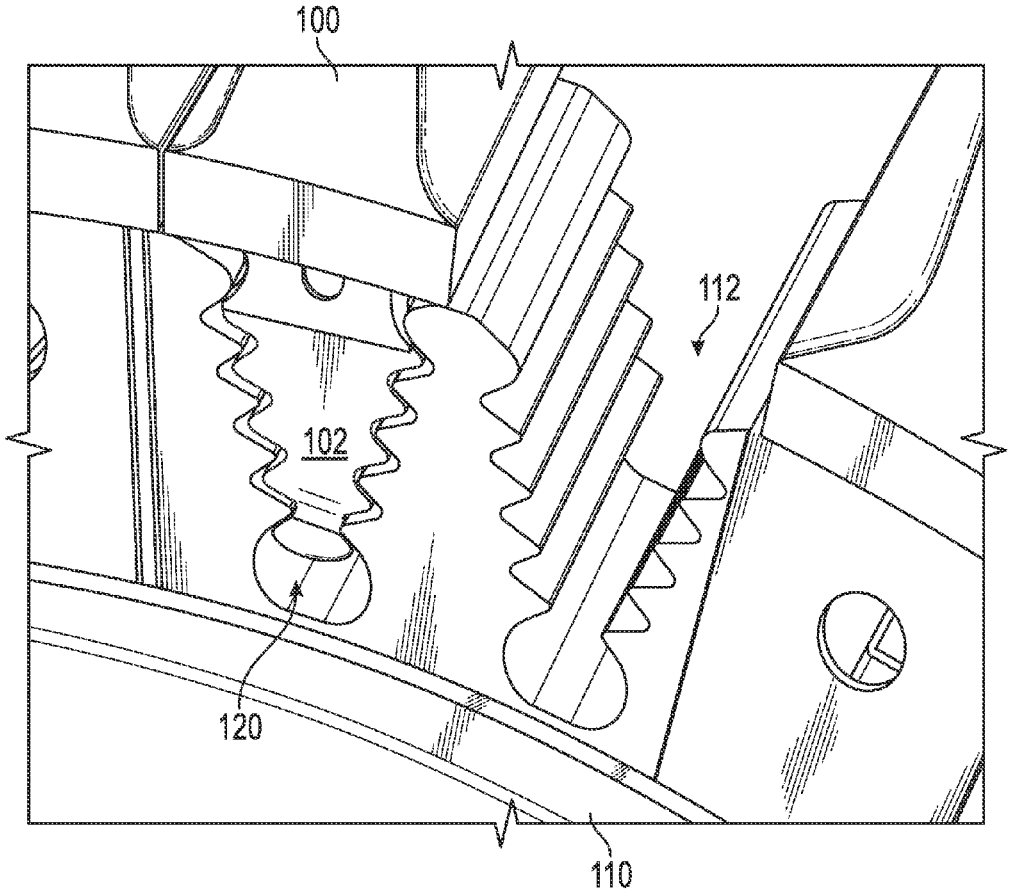
FIG. 2 is an illustration of a turbine blade attachment to a rotor disk with a fir tree cavity shape.

FIG. 2 is an illustration of a turbine blade 100, which could be any of the blades 22-28 of FIG. 1, and its attachment to a rotor disk 110. In this design, which has proven to be reliable and effective, the blade 100 has a blade root 102 with an inverted "fir tree" shape, and the rotor disk 110 has a complementary fir tree shaped cavity 112. With this design, the turbine blade 100 can be installed in the rotor disk 110 by simply sliding the blade 100 in a longitudinal direction (parallel to the rotational axis of the turbine) so that the fir tree shape of the blade root 102 engages with the mating cavity 112 in the rotor disk 110. In this design, there is necessarily some looseness between the blade root 102 and the disk cavity 112, both to allow for easy installation and removal of the blade 100, and to allow for differing radial growths due to thermal expansion and/or centrifugal forces.

When the turbine 10 is running at operational speed, centrifugal force pulls the blade 100 radially outward so that the looseness is all taken up, and contact points on the branches of the fir trees are pressed tightly against each other. However, turbines are sometimes operated in a low-speed "stand by" mode, also known as "turning gear" operation, intended to maintain the turbine 10 in a state of operational readiness. Turning gear operation typically occurs at speeds less than 100 rpm. In turning gear operation, the centrifugal force of rotation is not enough to overcome the force of gravity. As a result, each blade experiences radial inward/outward and rocking/tilting movements on each rotation of the turbine shaft due to the looseness of the blade root 102 in the fir tree shaped cavity 112. Over long durations, these repeated movements of the turbine blade 100 relative to the rotor disk 110 cause excessive wear on contact points of the blade fir trees and disk cavities, as well as on blade tip shrouds. In order to prevent this motion of the blade 100 relative to the disk 110 during low speed turbine operation, it is desirable to install a device in a space 120 below the tip of the blade root 102, in the bottom of the cavity 112, where the device can apply a radial outward force on the bottom of the blade 100. The device can be designed such that the force is sufficient to keep the blade 100 pressed radially outward ("upward" in FIG. 2) so that the blade root 102 is fixed in position in the cavity 112.

In addition to helping to avoid wear between turbine blade root fir trees and disk slots during turning gear operation, installation of blade root fixation devices that keeping the turbine blades 100 forced in their running position at all times may help avoid balance variations from run to run that can potentially contribute to rotor vibration. Noticeable improvements in vibration behavior coincided with the installation of such devices on the blades 100 of multiple turbine units.

Other devices which have been developed to provide the radial outward force on the blade 100 have several drawbacks. Some such devices cannot be expanded after being placed into the space 120; thus, these devices are difficult to insert into the space 120, and they scrape along the tip of the blade root 102 and the bottom of the cavity 112 and damage these surfaces when being inserted. Other such devices cannot be adjusted to provide a desired amount of radial force on the blade 100 in spite of part-to-part dimensional variations, or allow for an initial radial force adjustment but the radial force changes dramatically with thermal expansion during turbine operation.

Figure 3:
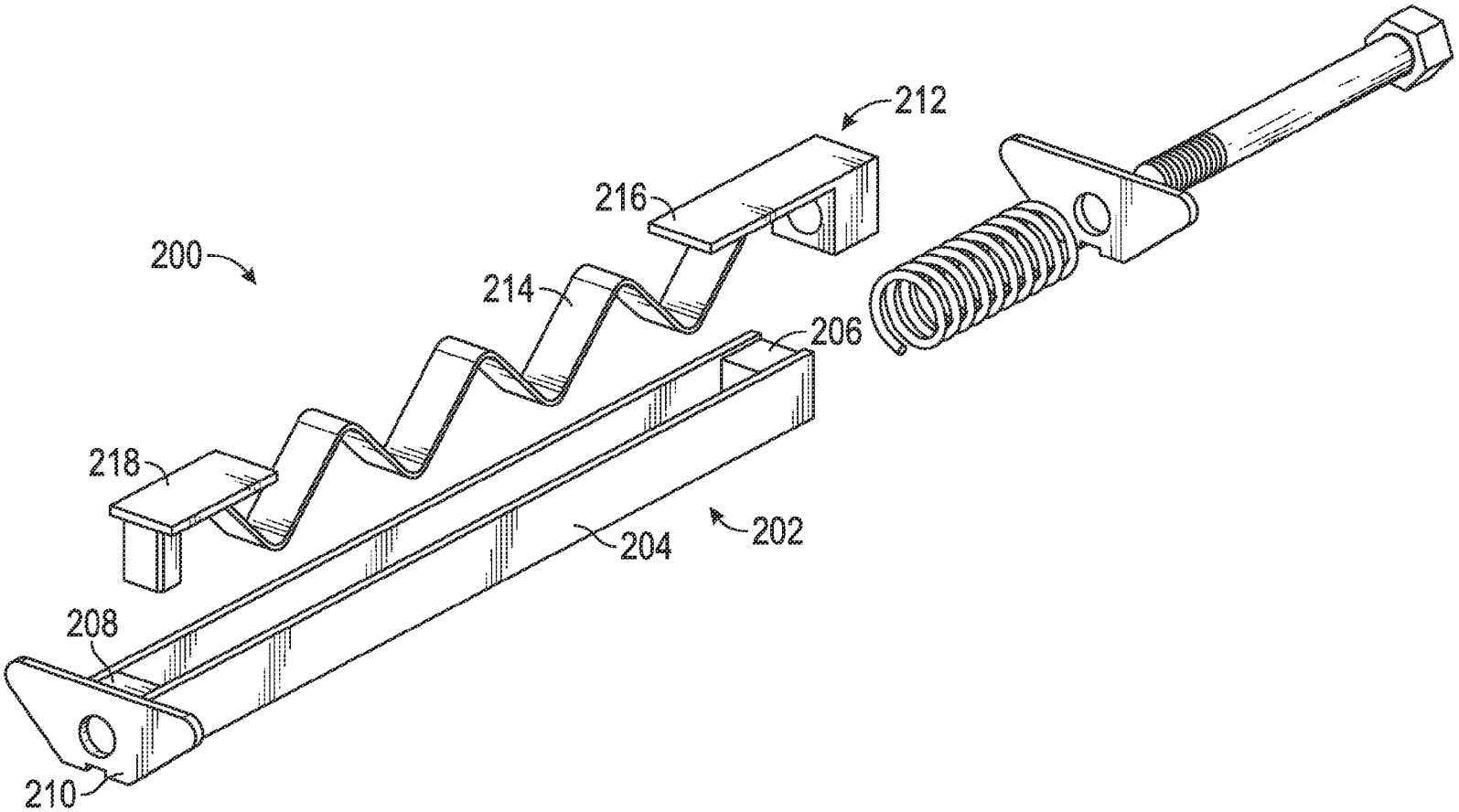
FIG. 3 is an exploded-view illustration of an adjustable blade root spring device for fixing the turbine blade of FIG. 2 in position in the rotor disk.
Figure 4:
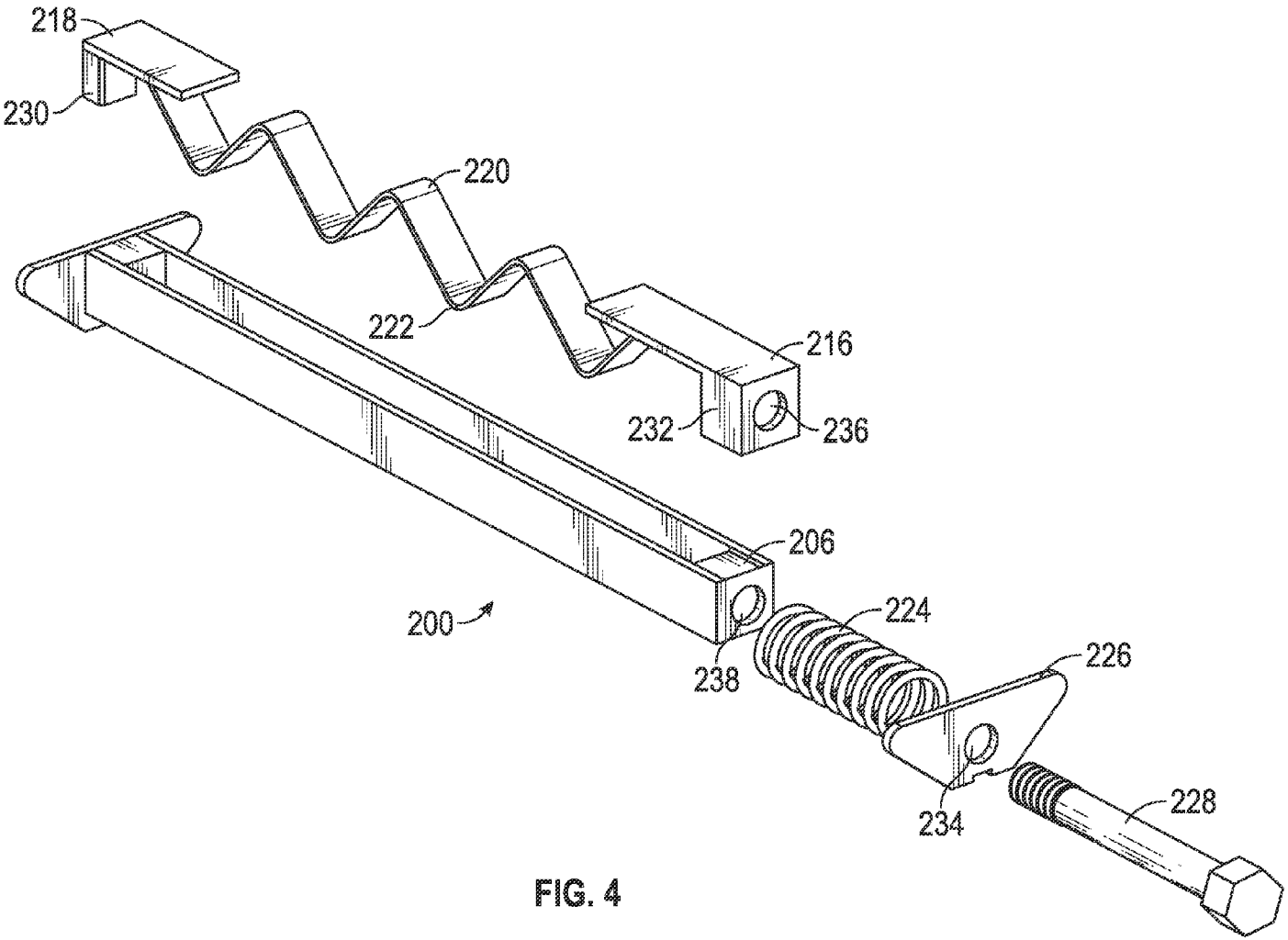
FIG. 4 is another exploded-view illustration, from a different point of view, of the adjustable blade root spring device for fixing the turbine blade in position in the rotor disk.

FIGS. 3 and 4 are exploded-view illustrations of a new adjustable blade root spring device 200 for fixing the turbine blade 100 in position in the rotor disk 110. The adjustable blade root spring device 200 overcomes the drawbacks of other turbine blade fixation devices. As will be discussed in detail below, the device 200 can be easily inserted into the space 120 in an uncompressed state, thereby not damaging the blade root 102 or the cavity 112. The device 200 has a design which distributes contact forces along the length of the blade root 102 and the bottom of the cavity 112, and is robust to the tolerances of the parts involved. The device 200 is also designed to self-adjust to changes in the height of the space 120 due to thermal expansion.

The device 200 includes an outer body 202 including two flat side walls 204 spaced apart by a first end block 206 at one end and a second end block 208 at the other end. The outer body 202 can be fabricated of separate pieces, with the side walls 204 being attached to the end blocks 206 and 208, or the outer body 202 can be machined from a single piece of material. At one end of the outer body 202—the end including the second end block 208—a fixed washer 210 is attached by welding or brazing. Thus, the outer body 202 defines a shape which is bounded on the two sides by the side walls 204, on the two ends by the end blocks 206 and 208, and open on the top and bottom. A wiggle spring assembly 212 comprises a wiggle spring 214, a spring bracket 216 and an L-bracket 218. The spring bracket 216 is attached, preferably by welding, to one end of the wiggle spring 214. The L-bracket 218 is welded to the other end of the wiggle spring 214 as shown.

The wiggle spring 214 is made of a flat piece of a nickel-based alloy—selected for its corrosion and oxidation resistance and high strength at elevated temperatures—loosely folded into an accordion shape, as shown in FIGS. 3 and 4. In one embodiment, the wiggle spring 214 may be fabricated from a strip of INCONEL® alloy X-750 having a width in a range of 0.25-0.35 inches and a nominal thickness of 0.025 inches. The design of the wiggle spring 214 is significant in several regards. First, the wiggle spring 214 must be folded so that the pitch is not too fine and not too coarse. If the wiggle spring 214 were to be made with a much finer pitch (say, 10 or 20 folds instead of 3 or 4), then the wiggle spring 214 would not exhibit the desired increase in height when compressed, as discussed below. If the wiggle spring 214 were to be made with a more coarse pitch (say, 1 or 2 folds), then the wiggle spring 214 would likely buckle in an uncontrolled manner when compressed, instead of providing the desired jacking motion. It has been found that, for the turbine blade 100, where the space 120 has a depth of approximately 6-8 inches, the wiggle spring 214 should have 3-4 full folds along its length.

The design of the wiggle spring 214 shown in FIGS. 3 and 4, with three upper apex points 220 and four lower apex points 222, has been shown to provide good results for the intended application. The bend radius at the apex points 220 and 222 is also important, as too small of a bend radius can create excessive stress concentration at the apex points 220/222, and too large of a bend radius affects the compliance properties of the wiggle spring 214. It has been found that a bend radius at the apex points 220/222 in a range of 0.085-0.090 inches is optimal.

The adjustable blade root spring device 200 also includes a coil spring 224, a washer 226 and a bolt 228. To begin assembly of the device 200, the wiggle spring assembly 212 is placed down into the outer body 202 such that the wiggle spring 214 is between the end blocks 206 and 208 and between the side walls 204, a block portion 230 of the L-bracket 218 is inside the outer body 202 and abutted against an inner face of the end block 208, and a block portion 232 of the spring bracket 216 is outside the outer body 202. Next, the bolt 228 is placed through a hole 234 in the washer 226, through the coil spring 224 and through a hole 236 in the spring bracket 216. The bolt 228 is then threaded into a threaded hole 238 in the end block 206. The bolt 228 is threaded into the threaded hole 238 until the head of the bolt 228 is in contact with the washer 226, the washer 226 is in contact with the coil spring 224, and the coil spring 224 is in contact with the end of the block portion 232 of the spring bracket 216. At this point, the wiggle spring 214 is not compressed from its as-manufactured shape, the assembly of the device 200 is complete, and the device 200 is ready to be inserted into the space 120.

Figure 5:
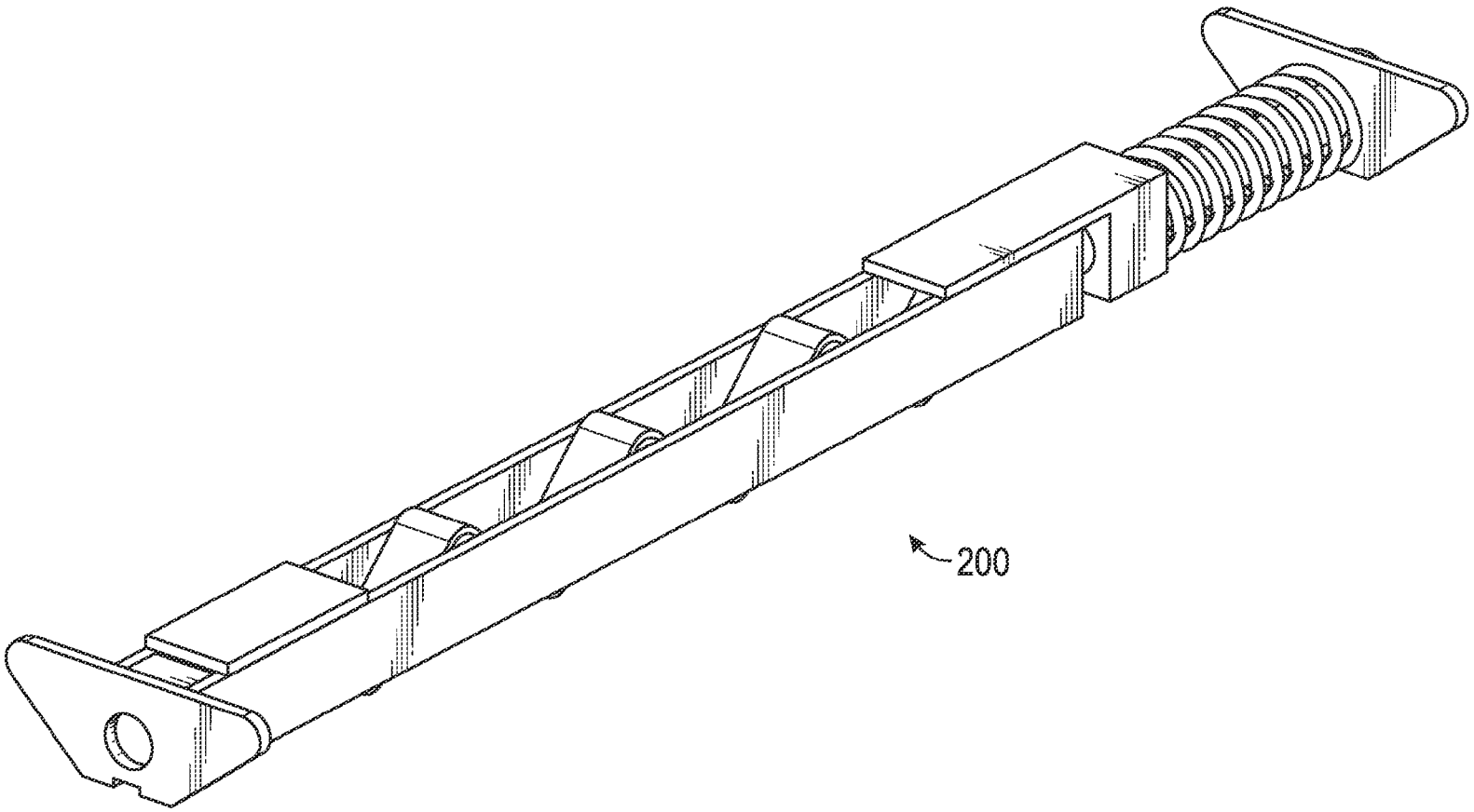
FIG. 5 is an illustration of the adjustable blade root spring device of FIG. 3 as fully assembled.

FIG. 5 is an illustration of the device 200 as fully assembled. In this view, it can be seen how the device 200, when assembled, is long and slender and can be slid into the space 120 between the blade root 102 and the bottom of the cavity 112. Before inserting into the space 120, the device 200 is assembled as shown in FIG. 5, but the coil spring 224 and the wiggle spring 214 are not compressed. Therefore, the wiggle spring 214 is at its free, or as-manufactured, length and height. After inserting into the space 120, the bolt 228 is tightened such that the coil spring 224 is compressed and bears against the spring bracket 216, thus compressing the wiggle spring 214.

Figure 6:
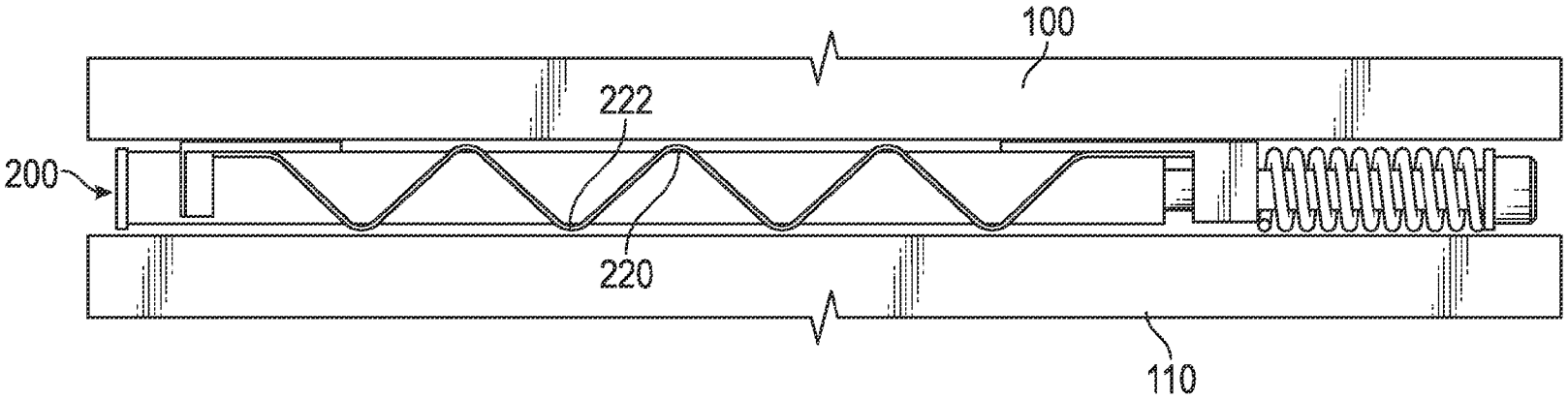
FIG. 6 is a side view illustration of the adjustable blade root spring device in the space between the turbine blade and the rotor disk.

When compressed, the wiggle spring 214 becomes shorter in length and taller in height, thereby providing a jacking effect between the blade root 102 and the bottom of the cavity 112. FIG. 6 is a side view illustration of the device 200 in the space 120 between the blade 100 and the disk 110. In this view, with the nearer of the side walls 204 not shown, it can be clearly seen how the upper apex points 220 press "up" (radially outward) on the bottom of the blade 100, and the lower apex points 222 press "down" (radially inward) on the rotor disk 110. It can also be seen in FIG. 6 how threading the bolt 228 into the end block 206 (not shown in FIG. 6) compresses the coil spring 224 against the spring bracket 216, thus squeezing the wiggle spring 214 into a shorter length and a taller height. The bolt 228 can be tightened to any suitable degree, which could be a prescribed number of turns beyond first loading of the coil spring 224, or a prescribed torque, or a prescribed amount of bolt rotation after reaching a torque threshold, where the torque threshold could be established to correspond to the wiggle spring 214 providing the desired compressive force against the blade root 102 and the bottom of the cavity 112.

It is important that the bolt 228 does not back out after it is tightened to provide the desired compression of the wiggle spring 214, as discussed above. Standard lock washers or other friction devices may be used to prevent undesired turning of the bolt 228 after installation of the device 200. However, it may be desirable to include a feature which provides positive fixation of the head of the bolt 228 to prevent rotation after installation.

Figure 7:
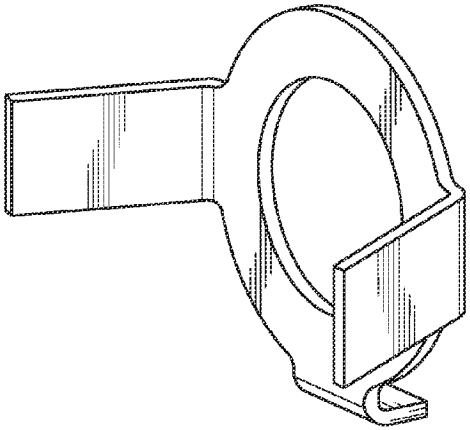
FIG. 7 is an illustration of a bent tab washer which can be installed between a washer and a head of a bolt in the adjustable blade root spring device.

FIG. 7 is an illustration of a bent tab washer 240 which can be installed between the washer 226 and the head of the bolt 228. As shown in FIG. 7, the bent tab washer 240 is in its as-manufactured state, with tabs 242 bent almost perpendicular to the plane of the sheet metal from which the bent tab washer 240 was stamped, but still leaving space to allow for turning the head of the bolt 228. The bolt 228, while shown in the figures as having a standard hex head, can have any head design suitable for the application. For example, the bolt 228 could include a recess for an allen wrench or star wrench, or straight or Phillips screwdriver slots. The bolt 228 could also have a square or rectangular four-sided head. It is simply required that the bolt 228 can accept a wrench or screwdriver for turning, and that its head has flats which can be held in position by the tabs 242 of the bent tab washer 240.

Figure 8:
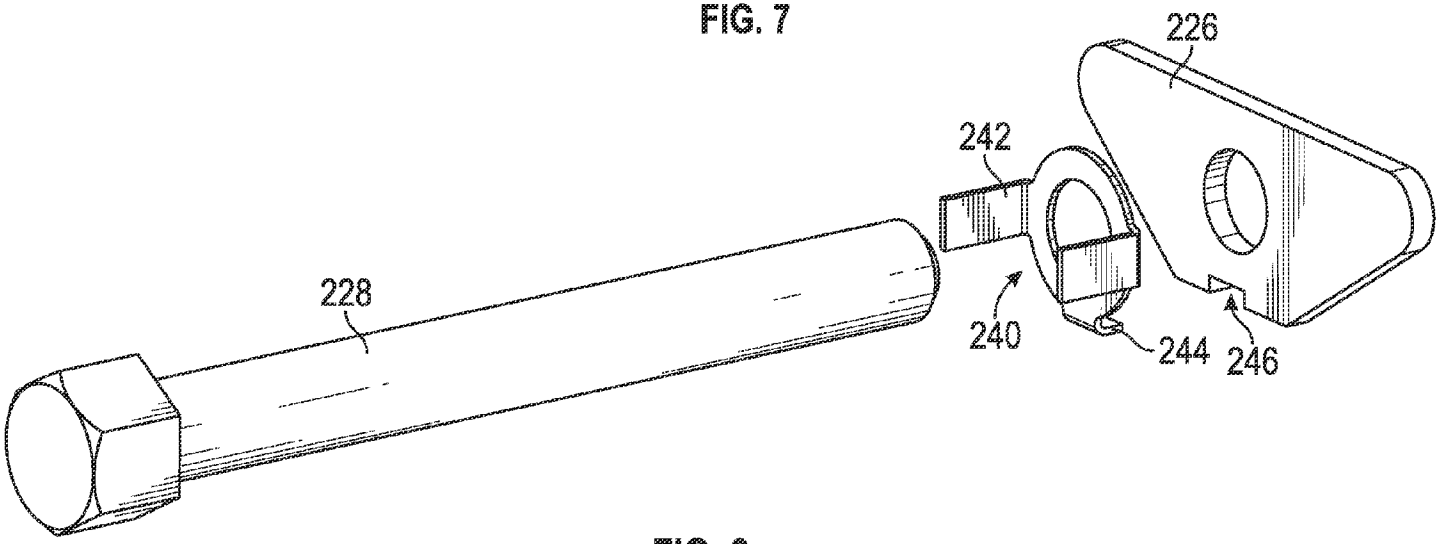
FIG. 8 is an exploded-view illustration of the bent tab washer in position between the washer and the head of the bolt.

FIG. 8 is an exploded-view illustration of the bent tab washer 240 in position between the washer 226 and the head of the bolt 228. As can be seen in FIGS. 7 and 8, the bent tab washer 240 also includes an engagement tab 244 which fits into a notch 246 in the washer 226. The engagement tab 244 prevents rotation of the bent tab washer 240 relative to the washer 226. After the bolt 228 has been tightened as discussed above during installation of the device 200 in the space 120, the tabs 242 are bent or squeezed such that they press against the flats on the head of the bolt 228. In this final configuration, rotation of the bolt 228 relative to the bent tab washer 240 is prevented. The bent tab washer 240 is further prevented from rotating relative to the washer 226 as discussed above, thus fixing the bolt 228 and the entire device 200 in the desired, compressed position.

It is also noted that the device 200 can easily be removed from the space 120, by reversing the installation steps described above. This is important because turbine blade removal and replacement is occasionally necessary, and it is desirable to reuse the device 200.

Figure 9:
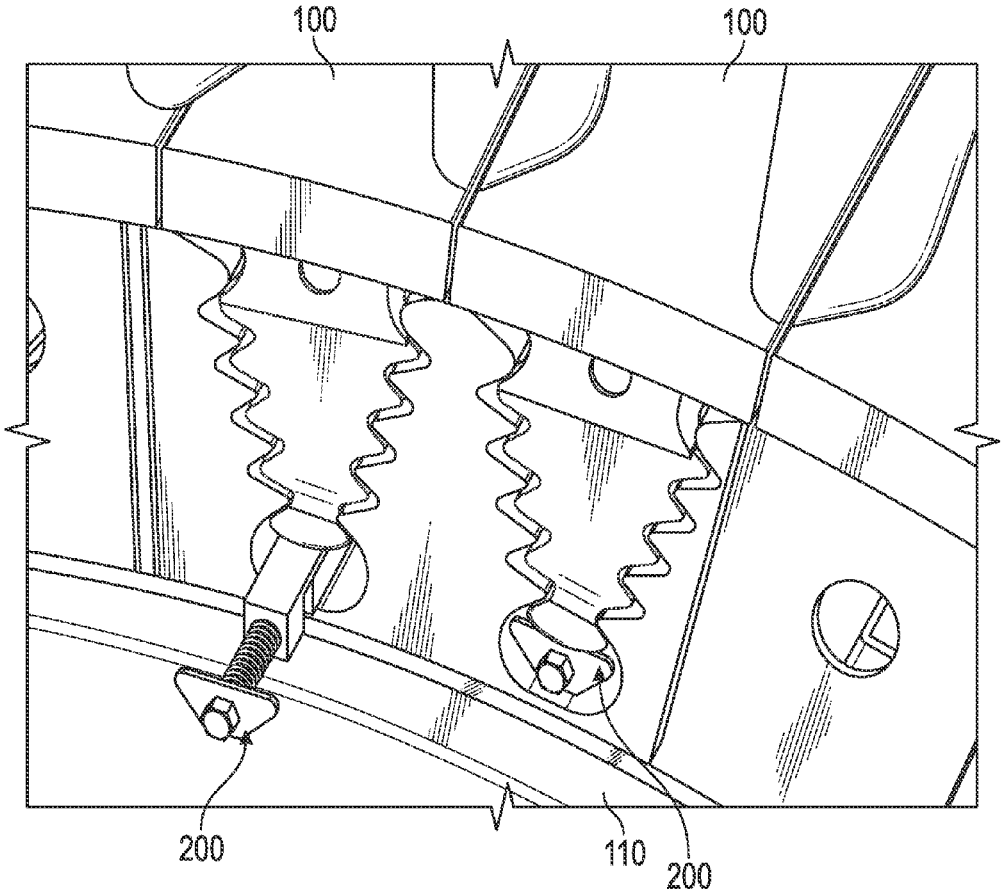
FIG. 9 is an illustration of two turbine blades attached to the rotor disk, with one of the adjustable blade root spring devices inserted into each of the two spaces between the blade and the disk.

FIG. 9 is an illustration of two of the turbine blades 100 attached to the rotor disk 110, with one of the adjustable blade root spring devices 200 inserted into each of the two spaces 120. On the left side of FIG. 9, the device 200 is partially inserted into the space 120. As discussed above, the device 200 can be freely inserted into the space 120, without scraping or scratching the surfaces of the blade 100 or the disk 110, because the device 200 is not vertically expanded until after insertion into the space 120. On the right side of FIG. 9, the device 200 is fully inserted into the space 120. It can be seen how the shape of the fixed washer 210 and the washer 226 generally match the shape of the space 120, thus precluding any washer rotation. This prevents the outer body 202 from rotating when the bolt 228 is tightened during installation, and prevents either the outer body 202 or the washer 226 from rotating after the device 200 has been installed.

Several features of the adjustable blade root spring device 200 warrant further discussion. First, as mentioned above, the device 200 can be installed and removed without damaging the turbine blade 100 or the rotor disk 110. This is important both for ease of installation and because any scraping or scratching of the blade 100 and the disk 110 could not only damage these components, but also create a potential foreign object damage problem in the turbine 10.

Another valuable feature of the device 200 is that the radial load applied to the blade 100 can be adjusted as desired. This is accomplished by simply specifying a torque or angular rotation to apply to the bolt 228 which results in a compressive force on the wiggle spring 214 which provides the desired radial blade force. This adjustability of radial force allows the device 200 to be used in different turbine applications and operating conditions. Furthermore, the bolt 228 can be further adjusted if necessary, after installation of the device 200 and reassembly of the turbine 10. This further adjustment of the bolt 228 can be accomplished without significant disassembly of the turbine 10 by simply providing an access port/hole through a lock plate which covers the end of the blade root 102 and the cavity 112.

It is also noteworthy that the device 200 does not require any special features to exist on either the turbine blade 100 or the rotor disk 110. This is important because it is undesirable to make design changes to parts—such as the blade 100 or the disk 110—which have been validated for production, and which have been proven in field operation. The device 200 can be used with existing fir tree designs of the blade root 102 and the disk cavity 112.

The device 200 is also designed to evenly distribute the radial force along the bottom of the blade 100. Even in the presence of manufacturing tolerances and surface irregularities, where the height of the space 120 may not be perfectly uniform along its depth, the apex points 220 and 222 of the wiggle spring 214 will each make contact with the blade 100 or the disk 110, and the radial force at each of the apex points 220/222 will tend to balance out. That is, for example, one of the upper apex points 220 will not tend to take all of the radial force, to the exclusion of the other upper apex points 220, because the adjacent sections of the wiggle spring 214 will naturally compress further to prevent this from happening.

Furthermore, the radial load applied by the device 200 self-compensates when the height of the space 120 changes due to thermal expansion. This is made possible by the presence of the coil spring 224. Consider a design where the coil spring 224 is not included in the device 200, and the wiggle spring 214 is directly compressed by the bolt 228 pressing against the spring bracket 216. In such a design, a desired radial force could be applied to the blade 100 by the wiggle spring 214 when the bolt 228 is tightened. However, if the height of the space 120 increases slightly due to thermal expansion, the amount of radial force applied to the blade 100 would drop dramatically, or disappear completely, because the apex points 220 and 222 of the wiggle spring 214 would quickly lose contact with the blade 100 and the disk 110. This is because, in this fictional design with no coil spring, the spring bracket 216 would be experiencing a positional constraint associated with the installed position of the bolt 228.

Returning to the actual design of the device 200 shown in the preceding figures, including the coil spring 224, it can be seen that a much more robust load compensation is inherent. Again, consider that the height of the space 120 increases slightly due to thermal expansion. Because the coil spring 224 applies a force boundary condition to the spring bracket 216—not a positional boundary condition as in the no-coil-spring design discussed above—the device 200 will maintain most of the radial force on the bottom of the blade 100. Specifically, the wiggle spring 214 will further compress as necessary to maintain contact with the blade 100 and the disk 110, and the coil spring 224 will uncompress by the same amount. However, the amount that the coil spring 224 uncompresses will be small in comparison to its preload compression, thereby maintaining nearly the same amount of preload.

In order to achieve the load-compensation effect described in the preceding two paragraphs, the coil spring 224 may be specified with a spring rate in a range of 150-200 pounds/inch. The amount of coil spring preload on the spring bracket 216 may be in a range of 25-50 pounds, resulting in a radial force of the wiggle spring 214 on the bottom of the blade 100 of 150-250 pounds. These design specifications dictate that the coil spring 224 is compressed by a non-trivial amount, on the order of ¼ inch, when the bolt 228 is tightened during installation of the device 200. Thus, if the height of the space 120 increases due to thermal expansion, the coil spring 224 will uncompress only slightly, the axial load on the wiggle spring 214 will also change only slightly, and the radial force of the wiggle spring 214 on the bottom of the blade 100 will also change only slightly. The coil spring 224 thereby provides the desired blade force self-compensation in the device 200.

Using the device described above, the turbine blades in a gas turbine engine can be securely held in position relative to the rotor disk, even during low speed turbine operation where centrifugal forces are low. The positive turbine blade fixation achieved with the adjustable blade root spring device 200 prevents excessive blade wear during turning gear operation of the turbine, resulting in both improved turbine reliability and lower maintenance cost.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An adjustable blade root spring device for fixing a turbine blade in position in a rotor disk in a gas turbine, said device comprising:

an outer body including opposing side walls and first and second end blocks;

an accordion spring characterized by a plurality of straight segments folded in an alternating fashion into an accordion shape, with an apex point between each of the straight segments;

a spring bracket attached to a first end of the accordion spring;

an L-bracket attached to a second end of the accordion spring;

a coil spring;

an elongated washer; and a bolt, said bolt arranged to pass through the elongated washer, through the coil spring and through a hole in the spring bracket, said bolt being threaded into a hole in the first end block of the outer body, where threading the bolt into the hole in the first end block compresses the coil spring against the spring bracket and causes the accordion spring to increase in height such that the accordion spring presses the turbine blade radially outward relative to the rotor disk.

2. The device of claim 1 wherein the turbine blade includes a root portion having an inverted fir tree shape, the rotor disk includes a cavity shaped to receive the root portion of the turbine blade, and the cavity further includes a space adjacent to the root portion of the turbine blade where the device can exert a force radially outward on the turbine blade and radially inward on the rotor disk.

3. The device of claim 2 wherein the elongated washer has a shape which fits within the space adjacent to the root portion of the turbine blade but does not permit rotation of the elongated washer within the space.

4. The device of claim 2 wherein the accordion spring presses the turbine blade radially outward relative to the rotor disk with a force of at least 150 pounds, and the force fixes the turbine blade position in the rotor disk.

5. The device of claim 4 wherein the coil spring has a stiff-ness which causes the coil spring to compress by a compression amount when the bolt is tightened during installation of the device, and the compression amount is sufficient to absorb any relaxation of the accordion spring due to increased height of the space adjacent to the root portion of the turbine blade during turbine operation, while still maintaining the force within the range of 150-250 pounds.

6. The device of claim 5 wherein the stiffness of the coil spring is in a range of 150-200 pounds/inch.

7. The device of claim 2 further comprising a fixed washer attached to the second end block of the outer body, said fixed washer having an elongated shape which fits within the space adjacent to the root portion of the turbine blade but does not permit rotation of the fixed washer within the space, thus preventing rotation of the outer body within the space when the bolt is being tightened.

8. The device of claim 7 further comprising a bent tab washer located between a head of the bolt and the elongated washer, said bent tab washer including an engagement tab which engages a notch in the elongated washer and prevents rotation of the bent tab washer relative to the elongated washer, where tabs on the bent tab washer can be bent into a position which prevents rotation of the head of the bolt after the device has been installed in the gas turbine.

9. The device of claim 1 wherein the accordion spring is fabricated from a nickel-based alloy strip having a width in a range of 0.25-0.35 inches and a nominal thickness of 0.025 inches.

10. The device of claim 1 wherein the accordion spring is shaped so that three upper apex points contact the turbine blade and four lower apex points contact the rotor disk.

11. The device of claim 10 wherein the three upper apex points each provide a substantially equal contact force on the turbine blade, and the four lower apex points each provide a substantially equal contact force on the rotor disk.

12. A gas turbine engine rotor assembly, said assembly comprising:

a plurality of turbine blades, each turbine blade including a blade root portion having an inverted fir tree shape;

a rotor disk designed to hold the plurality of turbine blades in a circumferential arrangement around an outer periphery of the rotor disk, said rotor disk including a plurality of cavities, with one of the cavities for each of the turbine blades, where each of the cavities has a fir tree shape designed to receive the blade root portion of one of the turbine blades, and where each of the cavities also includes a space adjacent to and radially inward from the blade root portion; and an adjustable blade root spring device inserted into the space in each of the cavities, where the adjustable blade root spring device includes;

an outer body including opposing side walls and first and second end blocks;

an accordion spring characterized by a plurality of straight segments folded in an alternating fashion into an accordion shape, with an apex point between each of the straight segments;

a spring bracket attached to a first end of the accordion spring;

an L-bracket attached to a second end of the accordion spring;

a coil spring;

an elongated washer; and a bolt, said bolt arranged to pass through the elongated washer, through the coil spring and through a hole in the spring bracket, said bolt being threaded into a hole in the first end block of the outer body, where threading the bolt into the hole in the first end block compresses the coil spring against the spring bracket and causes the accordion spring to increase in height such that the accordion spring presses the turbine blade radially outward relative to the rotor disk.

13. The rotor assembly of claim 12 wherein the elongated washer has a shape which fits within the space adjacent to the blade root portion but does not permit rotation of the elongated washer within the space.

14. The rotor assembly of claim 12 wherein the coil spring has a stiffness which causes the coil spring to compress by a compression amount when the bolt is tightened during installation of the adjustable blade root spring device, and the compression amount is sufficient to absorb any relaxation of the accordion spring due to increased height of the space adjacent to the blade root portion during turbine operation, while still maintaining a force on the turbine blade of at least 150 pounds.

15. The rotor assembly of claim 12 wherein the accordion spring is shaped so that three upper apex points contact the turbine blade and four lower apex points contact the rotor disk, and the three upper apex points each provide a substantially equal contact force on the turbine blade, and the four lower apex points each provide a substantially equal contact force on the rotor disk.

16. The rotor assembly of claim 12 further comprising a fixed washer attached to the second end block of the outer body, said fixed washer having an elongated shape which fits within the space adjacent to the blade root portion but does not permit rotation of the fixed washer within the space, thus preventing rotation of the outer body within the space when the bolt is being tightened.

17. The rotor assembly of claim 16 further comprising a bent tab washer located between a head of the bolt and the elongated washer, said bent tab washer including an engagement tab which engages a notch in the elongated washer and prevents rotation of the bent tab washer relative to the elongated washer, where tabs on the bent tab washer can be bent into a position which prevents rotation of the head of the bolt after the adjustable blade root spring device has been installed in the space.

* * * * *